US007658345B2

(12) United States Patent
Wells et al.

(10) Patent No.: US 7,658,345 B2
(45) Date of Patent: Feb. 9, 2010

(54) FIBER HANDLING CART FOR CABLES WITH TETHERS

(75) Inventors: Dennis Ray Wells, Richfield, MN (US); Larry Sorenson, New Prague, MN (US)

(73) Assignee: ADC Telecommunications, Inc., Eden Prairie, MN (US)

( * ) Notice: Subject to any disclaimer, the term of this patent is extended or adjusted under 35 U.S.C. 154(b) by 0 days.

(21) Appl. No.: 11/804,714

(22) Filed: May 17, 2007

(65) Prior Publication Data

US 2008/0048063 A1 Feb. 28, 2008

Related U.S. Application Data

(60) Provisional application No. 60/801,319, filed on May 18, 2006.

(51) Int. Cl.
*B65H 75/00* (2006.01)

(52) U.S. Cl. ..... 242/577; 242/403.1; 242/404; 242/594.3; 242/594.4; 242/594.5

(58) Field of Classification Search ..... 242/557, 242/403.1, 404, 594.3–5, 129.6, 129.62, 242/129.7, 129.72, 129.8

See application file for complete search history.

(56) References Cited

U.S. PATENT DOCUMENTS

| | | | | |
|---|---|---|---|---|
| 3,934,854 | A * | 1/1976 | Goode | 254/134.3 R |
| 4,741,493 | A | 5/1988 | Schaiewitz | |
| 5,509,671 | A * | 4/1996 | Campbell | 280/47.19 |
| 5,915,646 | A | 6/1999 | Campbell | |
| 6,059,220 | A * | 5/2000 | Lassiter | 242/557 |
| 2003/0122027 | A1 * | 7/2003 | Bootsman et al. | 242/557 |

FOREIGN PATENT DOCUMENTS

| | | |
|---|---|---|
| DE | 44 28 657 A1 | 2/1996 |
| JP | 61-229780 | 10/1986 |
| JP | 63-206711 | 8/1988 |

* cited by examiner

*Primary Examiner*—Sang Kim
(74) *Attorney, Agent, or Firm*—Merchant & Gould P.C.

(57) ABSTRACT

A fiber axis cart includes a series of spools arranged side-by-side on a common shaft where the spools may be locked to turn with the shaft, or they may be made to turn independent of the shaft. A cable is wound onto the spools. The cable winding progresses to the next spool at each access point on the cable. Cable slack for working on each access point is obtained by unlocking the spools and allowing the spools to rotate with respect to an adjacent spool.

8 Claims, 10 Drawing Sheets

FIBER HANDLING CART FOR CABLES WITH TETHERS

CROSS-REFERENCE TO RELATED APPLICATION

This application claims priority from provisional application Ser. No. 60/801,319, filed May 18, 2006, and which is incorporated herein by reference.

BACKGROUND OF THE INVENTION

The present inventions concerns devices, systems and methods for adding cable tethers to a main cable, such as in a fiber optic distribution cable.

Such tethered cables are desired for outside plant applications where access points to the cable are desired at spaced apart intervals. In some applications, the intervals may be spaced apart by 100-500 feet or more. Typically, the intervals are varied, depending upon the application and the locations of the outside plant terminals.

SUMMARY OF THE INVENTION

The present inventions concerns devices, systems and methods for spooling or winding a cable into discrete areas on a series of spools arranged on a common shaft. Each discrete area is capable of unspooling a portion of the spooled up cable without unspooling an adjacent area. Such discrete unspooling allows for selective access to the cable at access points for adding tethers.

DETAILED DESCRIPTION OF THE PREFERRED EMBODIMENTS

Figure 1:
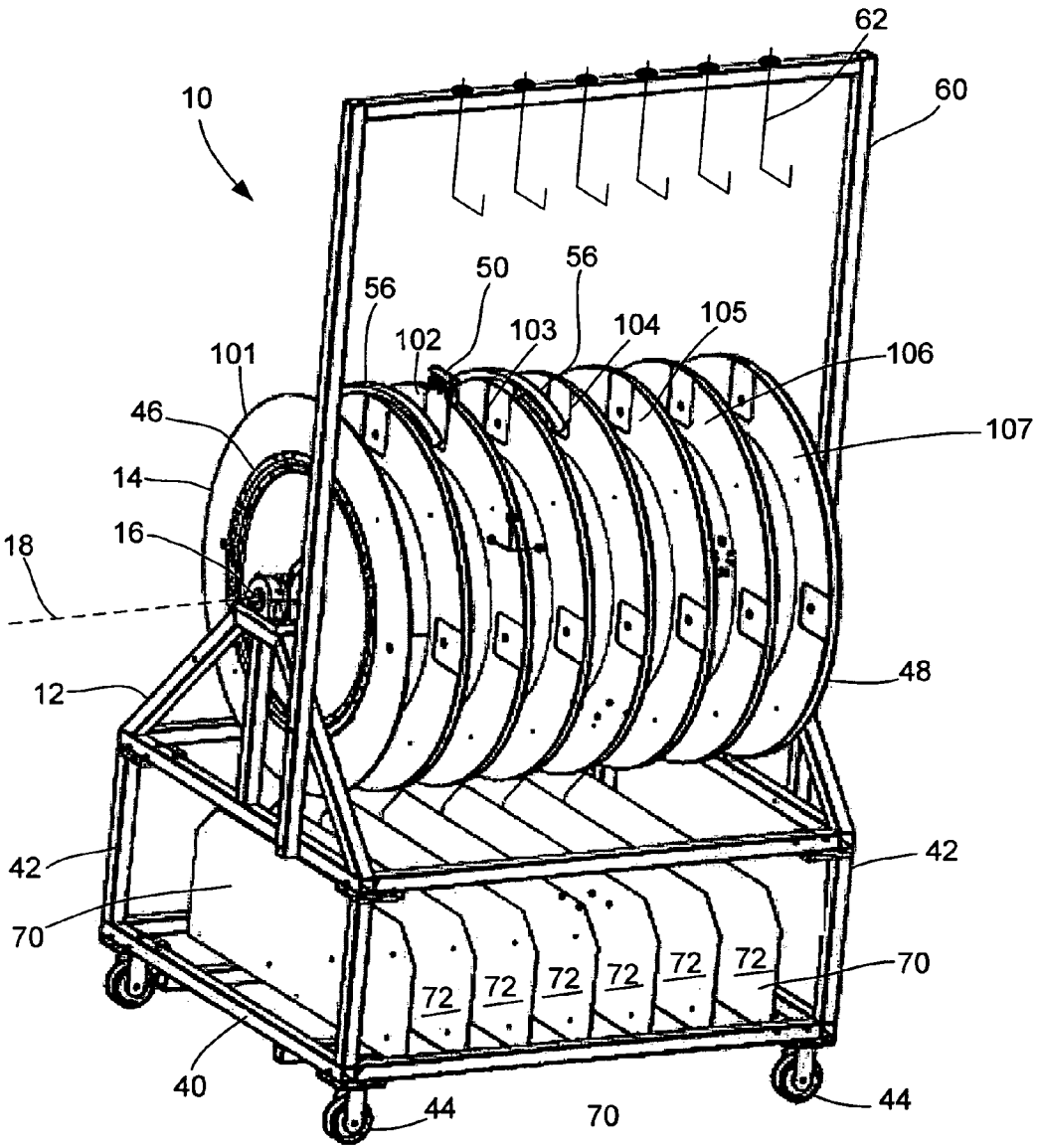
FIG. 1 is a perspective view of a fiber handling cart in accordance with one embodiment of the present invention.
Figure 2:
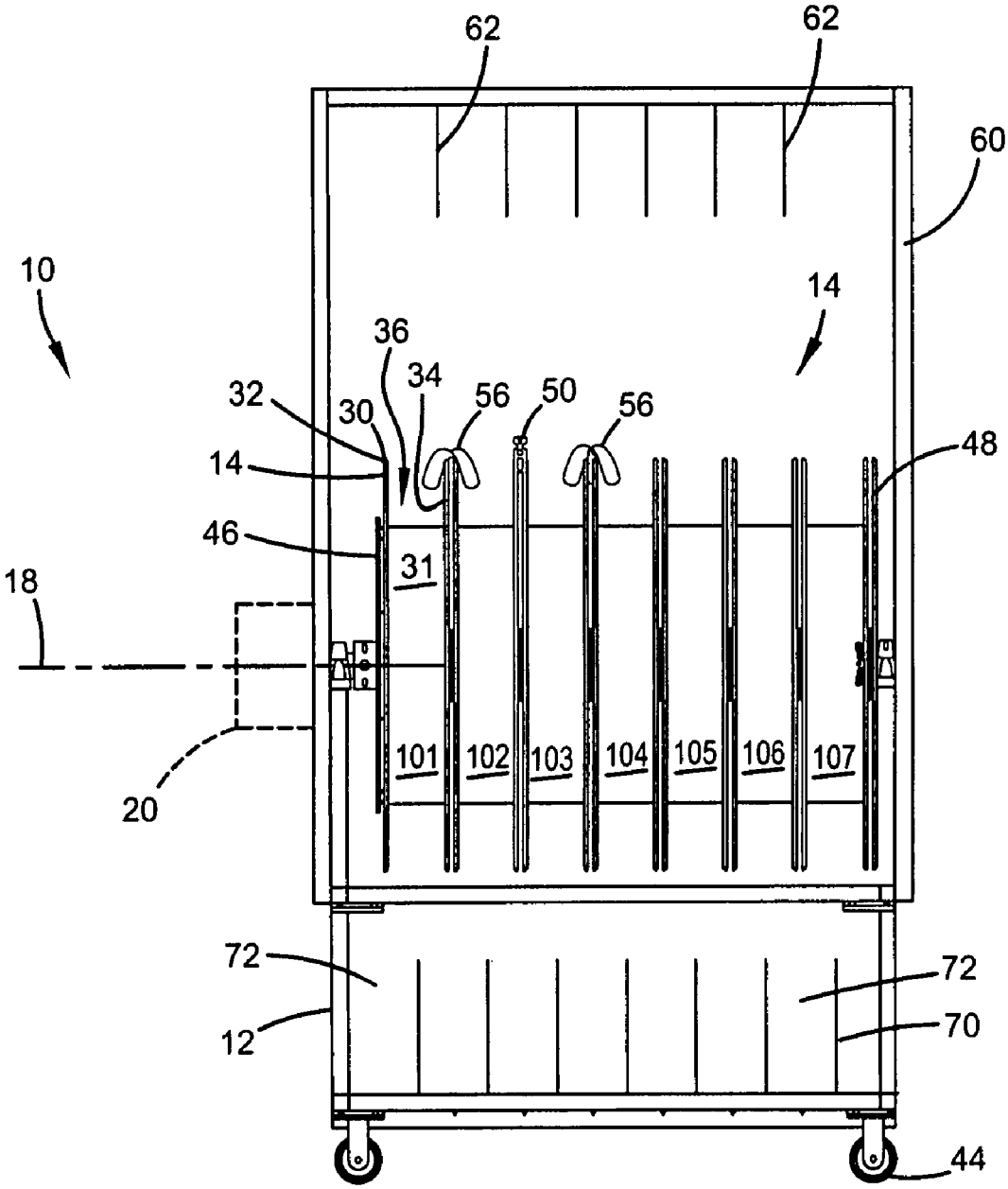
FIG. 2 is a front view of the fiber handling cart of FIG. 1.
Figure 3:
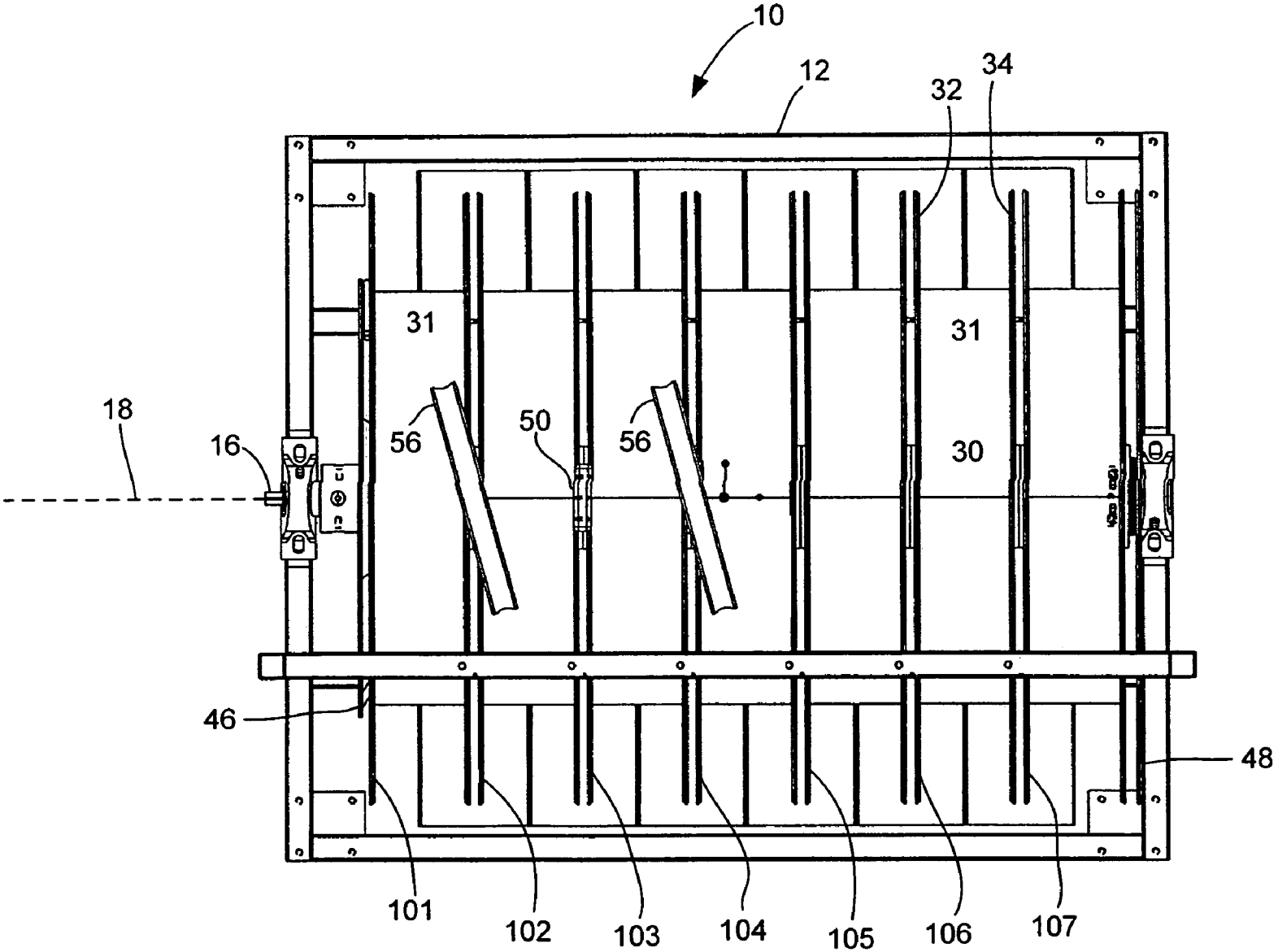
FIG. 3 is a top view of the fiber handling cart of FIG. 1.
Figure 4:
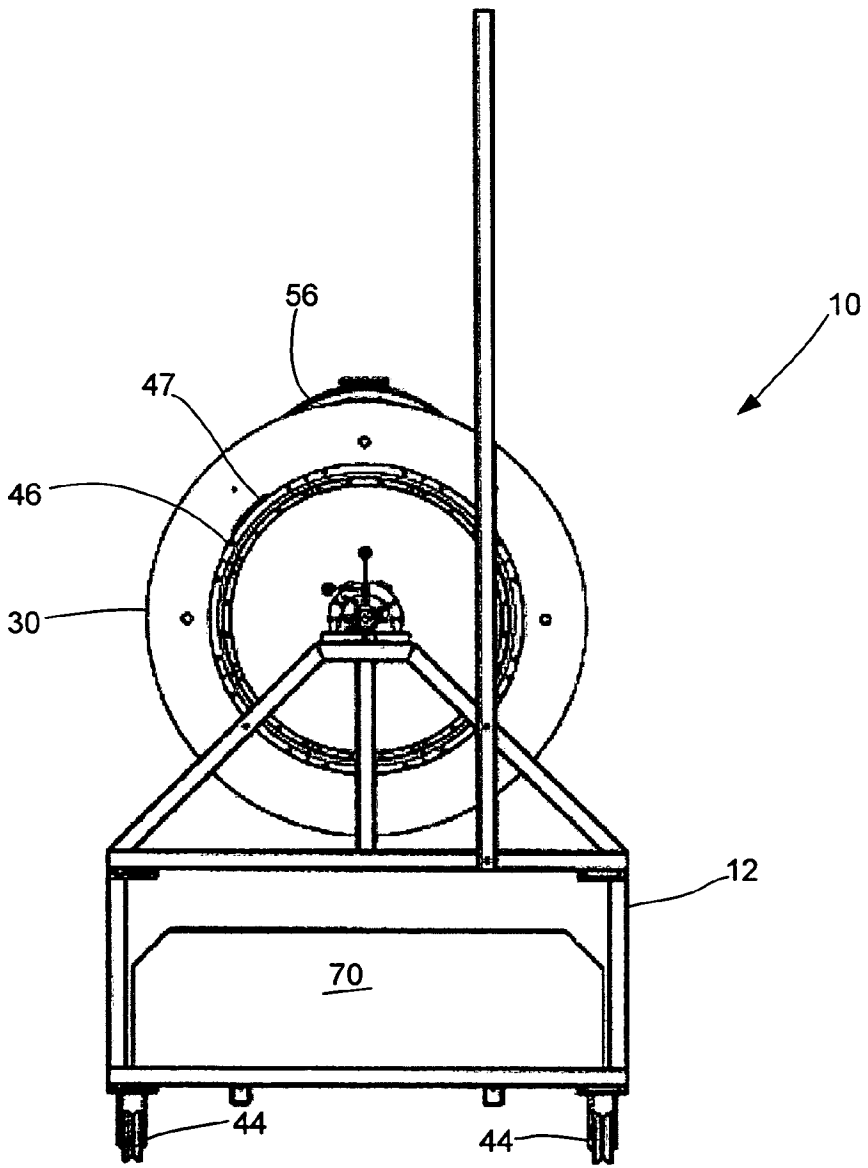
FIG. 4 is a side view of the fiber handling cart of FIG. 1.
Figure 5:
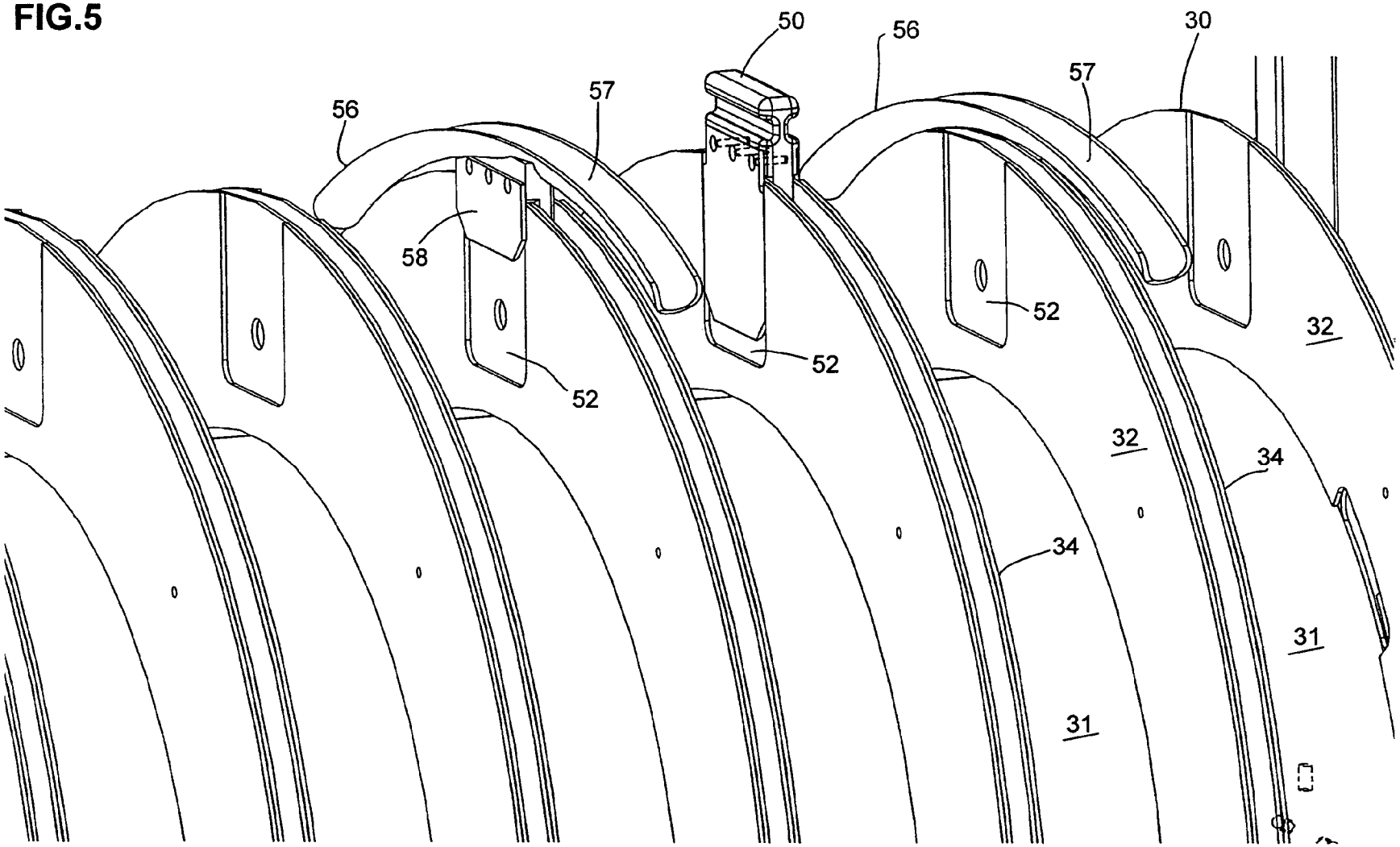
FIG. 5 is an enlarged top and rear perspective view of the fiber handling cart of FIG. 1.

Referring now to FIGS. 1-8, one preferred embodiment of a fiber handling cart 10 is shown. Cart 10 includes a series of spools 30 arranged side-by-side on a common shaft 16. Shaft 16 is supported by a frame 12. Together, spools 30 form a spool device 14 useful for processing a fiber optic cable including a plurality of spaced apart tethers at different points along the cable.

In general, there is one more spool 30 than the number of access points needed for the cable. Spools 30 maybe locked to turn with shaft 16 or they may be allowed to turn independent of the shaft. As will be described below, a cable is wound onto the spools where the winding progresses to the next spool near each access point on the cable. Cable slack for working on each access point may be obtained by unlocking a spool or spools and allowing the remaining spools to rotate with respect to the selected spool. Cart 10 makes it possible to manage and protect cables, such as cables as long as 3,000 feet, while allowing access to the access points for processing.

Cart 10 is mobile through the use of wheels 44 mounted on a frame base 40. Uprights 42 support shaft 16.

Each spool 30 includes a base 31, and opposite sides 32, 34 defining a cable winding area 36 for holding multiple windings of cable between each access point.

To enable the spools 30 to rotate together, a clamping feature is provided. In the illustrated embodiment, a plurality of clamps 50 are used to clamp adjacent spools together. Clamps 50 are received in recessed areas 52 of each spool 30. Other clamping devices can be used to selectively allow rotation of spools 30 with shaft 16. In the FIGS., spools 30 are differentiated with labels 101-107. Spool 101 is directly connected to shaft 16. To rotate each adjacent spool, a clamp 50 is used between each adjacent spool pair.

When each access point is identified during the spooling process, the access point is marked on the cable, and a further amount of cable (for example, several feet, up to 10-20 feet) is wound onto each spool to produce the necessary slack needed during the tethering process. A crossover feature is provided. In the illustrated embodiment, a crossover guide 56 allows for the remaining cable after the access point and slack to be further wound onto spool device 14. Crossover guide 56 allows the cable to jump over to the next spool 130 to prepare for the next access point. Crossover guide 56 includes a trough 57 for receiving the cable. A clip 58 can mount the crossover guide 56 to spool device 14. Alternatively, crossover guide 56 is loose and held in place by a tight fit of the cable windings. Crossover guide 56 can be located where ever a crossover is needed.

As shown in FIGS. 1-8, only two crossover guides 56 and one clamp 50 are shown. It is to be appreciated that the appropriate number of clamps 50 and crossover guides 56 are used for filing spool device 14 with the cable. There should be at least one clamp 50, and one crossover device 56 between each spool 30.

To unwind spool device 14 so as to access the access points, spool 107 is clamped to end flange 48 affixed to frame 12. The remaining spools are clamped together and driven by shaft 16. Any clamp that existed between spools 106 and 107 is removed. This clamp can be used to clamp spool 107 to end flange 48. To further unwind spool device 30, spool 106 is clamped to spool 107, and the remaining spools are driven by shaft 16. Similarly, any clamp between spools 105 and 106 is removed. This clamp can be used to clamp spool 106 to spool 107. The process continues sequentially until the necessary unwinding of each spool occurs.

Cart 10 includes seven spools 30 for use in preparing six access points with tethers. It is to be appreciated that cart 10 can be constructed with additional spools to allow for additional numbers of access points to be processed on the wound cable. Further, cart 10 can be used to process a cable with less than six access points by only using the desired numbers of spools 30.

Referring now to FIGS. 6A, 6B, 7A, 7B, and 8, use of cart 10 to produce a cable with tethers will be described in greater detail. Cart 10 is used to produce a cable 80 with a plurality of tethers 84 extending from access points 88 on main cable 82.

Each tether 84 ends in a termination point 86. Termination points 86 can be one or more fiber optic connectors or other connection arrangement for connecting to further fiber optic cables extending to each customer's premises. Note that in FIG. 8, the distance between each of the first three access points 88 and the first three tethers 84 is different. Distances a, b, c, are different.

Figure 6B:
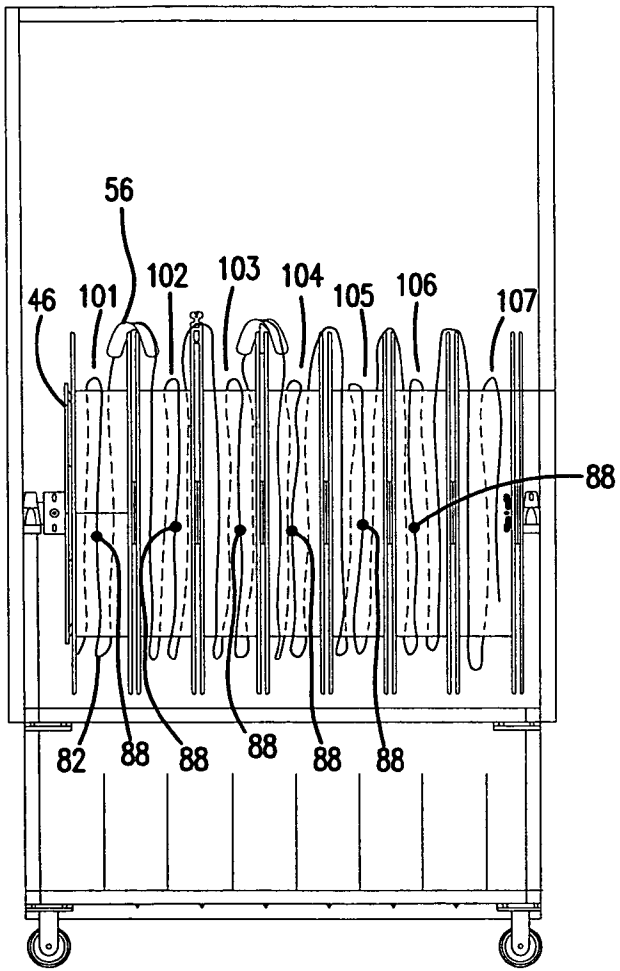
FIG. 6A is a flow chart representation of steps for winding of the cable onto the fiber handling cart, with reference to FIG. 6B where a cart is illustrated showing a representative cable.
Figure 6A:
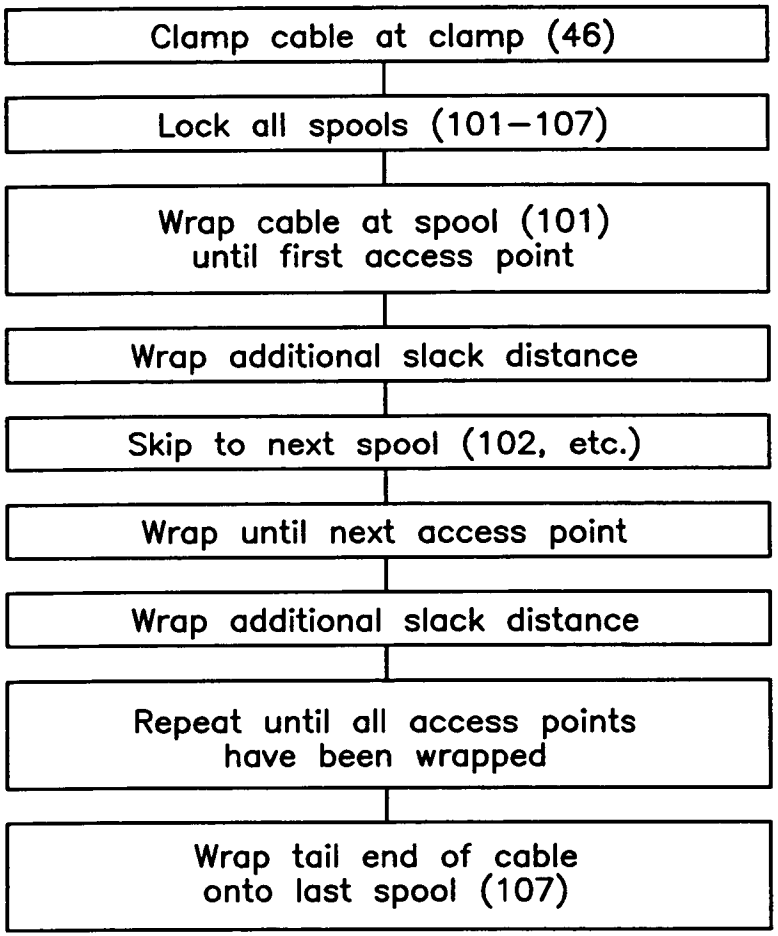

As described in FIG. 6A, and shown schematically in FIG. 6B, cable 82 is fed through slot 47 and clamped at main clamp 46. Clamp 46 has a wedge shape to hold cable 82 wrapped around clamp 46. A zip tie can be used to further hold cable 82 in clamp 46. Cable 82 is wound around successive spools 101-107. Each spool 101-106 includes an access point 88 marked by the technician during spooling (such as with tape). Each spool 101-106 is wound to include additional cabling so as to create slack for later use in adding tethers. For example, 8 to 20 feet or so of extra cabling may be wound to use as slack. A crossover feature is used between each spool, for example crossover guide 56 shown between spools 101 and 102. Once the last access point 88 is wound onto spool 106, the remaining tail end of cable 82 is wound on last spool 107. During the winding process, all of the spools 101-107 rotate together.

Figure 7B:
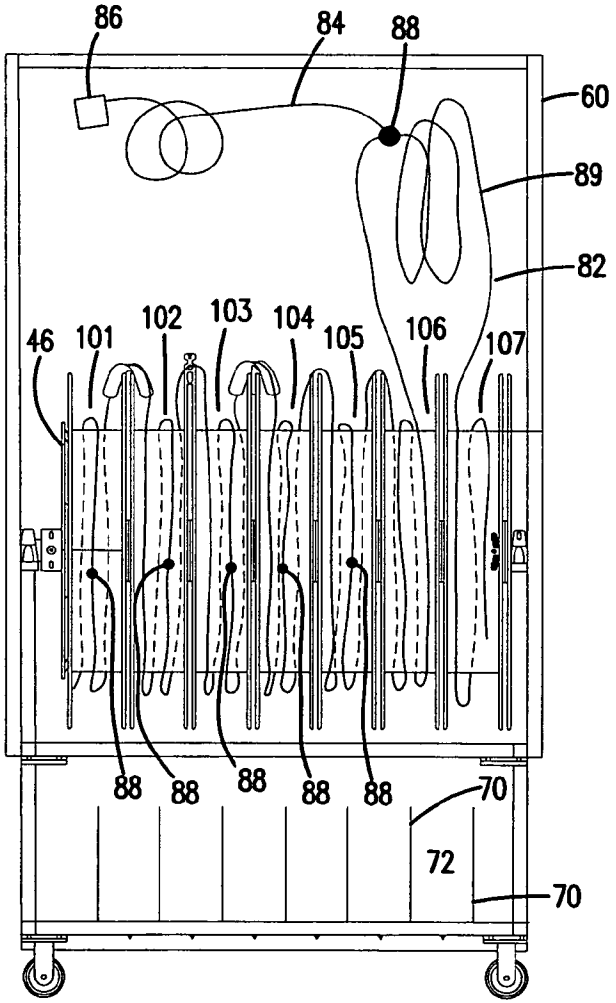
FIG. 7A is a flow chart representation of the steps for unwinding the spooled cable, and adding tethers at predetermined locations, as shown in FIG. 7B.
Figure 7A:
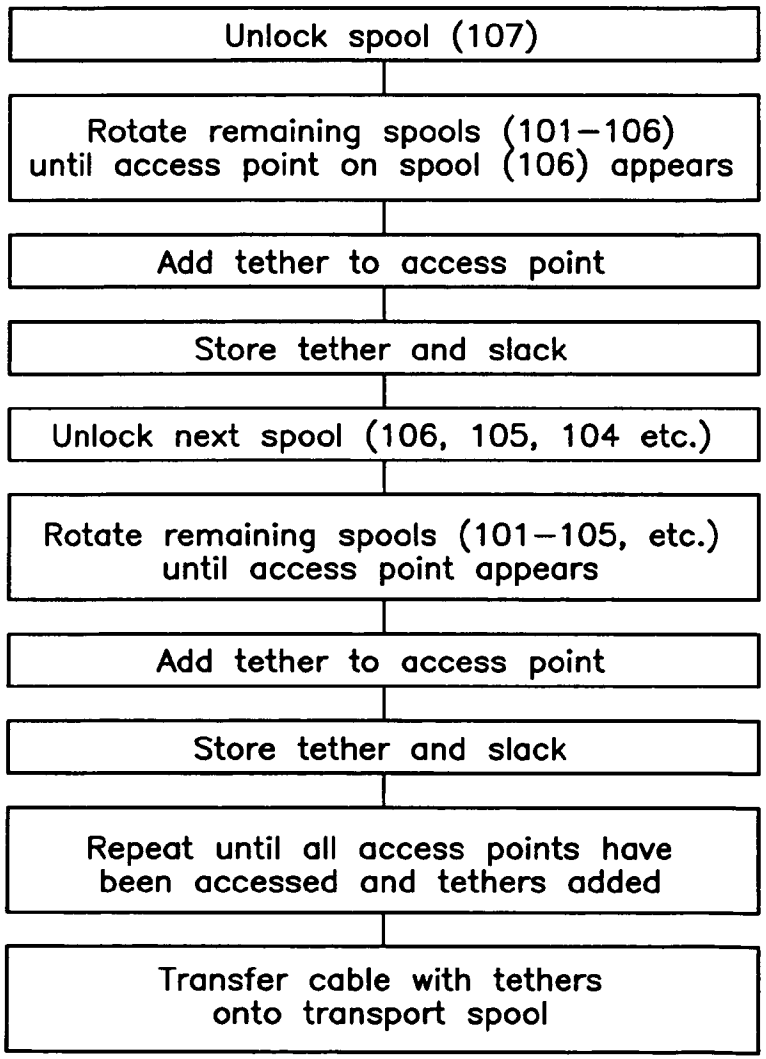
Figure 8:
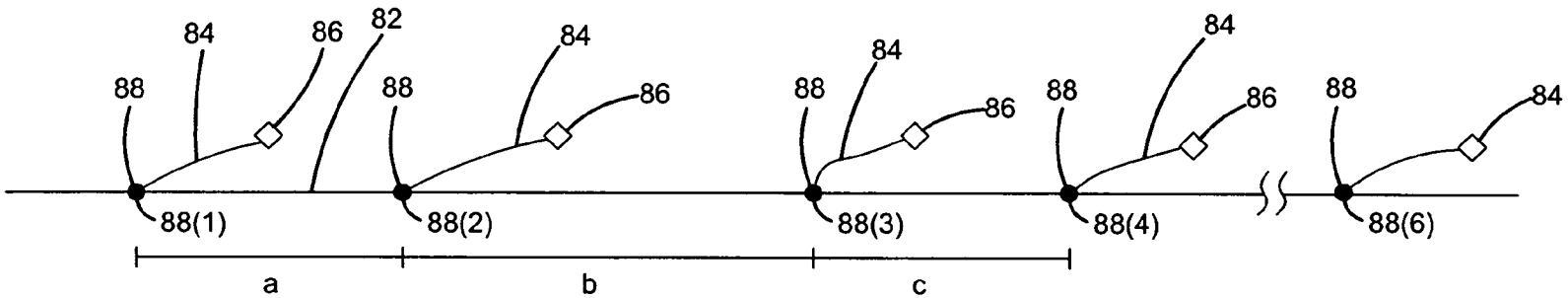
FIG. 8 is a schematic representation of a fiber optic cable including tethers.

Referring now to FIGS. 7A and 7B, the process for adding the tethers is described and shown. Spool 107 is unlocked from spool 106 and locked to flange 48, and the remaining spools 101-106 are rotated until the access point 88 on spool 106 is uncovered. The slack length 89 is shown schematically coiled up and access point 88 is exposed to allow attachment of tether 84 by the technician. Such attachment is by splicing. Each successive spool 106, etc. in descending order, is unlocked and relocked and each successive access point is accessed to allow attachment of the respective tether. Such tethering process can be done sequentially, or all access points can be exposed before the tethering process. Frame 60 and lower panels 70 defining slots 72 can be used to store and protect the exposed cabling during and after processing with the tethers. A hook 62 can be used to hold the tether. The cable slack around each spool can be fitted into slots 72.

The loose tethers and slack can be wound back onto spool device 14 by winding the tethers and slack in the same direction as initial winding. As each tether is wound, the clamps are moved so that each successive spool turns. The tethers can be attached to the main cables at their free ends.

Once the full cable 82 has been tethered, the cable can be unwound starting with the tail onto a transport spool or other transport device for shipping to the installation site.

The clamping system of the preferred embodiment uses clamps 50 to selectively clamp the spools to the drive spool or to the frame. Clamps 50 initially clamp all the spools 101-107 together and all the spools rotate relative to the frame for initial cable loading. The unwinding process to locate the access points for tethering uses the same clamping system, and one clamp at a time is moved over (to the right in the figures) to allow selective unwinding of a spool. Spool 107 is clamped to the frame and the rest are rotated to allow unwinding of spool 106. The next clamp is moved over to clamp spool 106 to spool 107 (and to the frame), and spool 105 is unwound. The process is repeated by moving each clamp over one location. Once all the access points have been tethered, the clamps are moved back one location at a time (to the left in the figures) to allow each spool, starting from spool 101, to be rewound to include the slack and the corresponding tether. Alternatively, the tethers can be attached and rewound sequentially by suitable positioning of the clamps.

Motor 20 can be used to drive shaft 16. Alternatively, spools 32 can be turned by hand.

Figure 9:
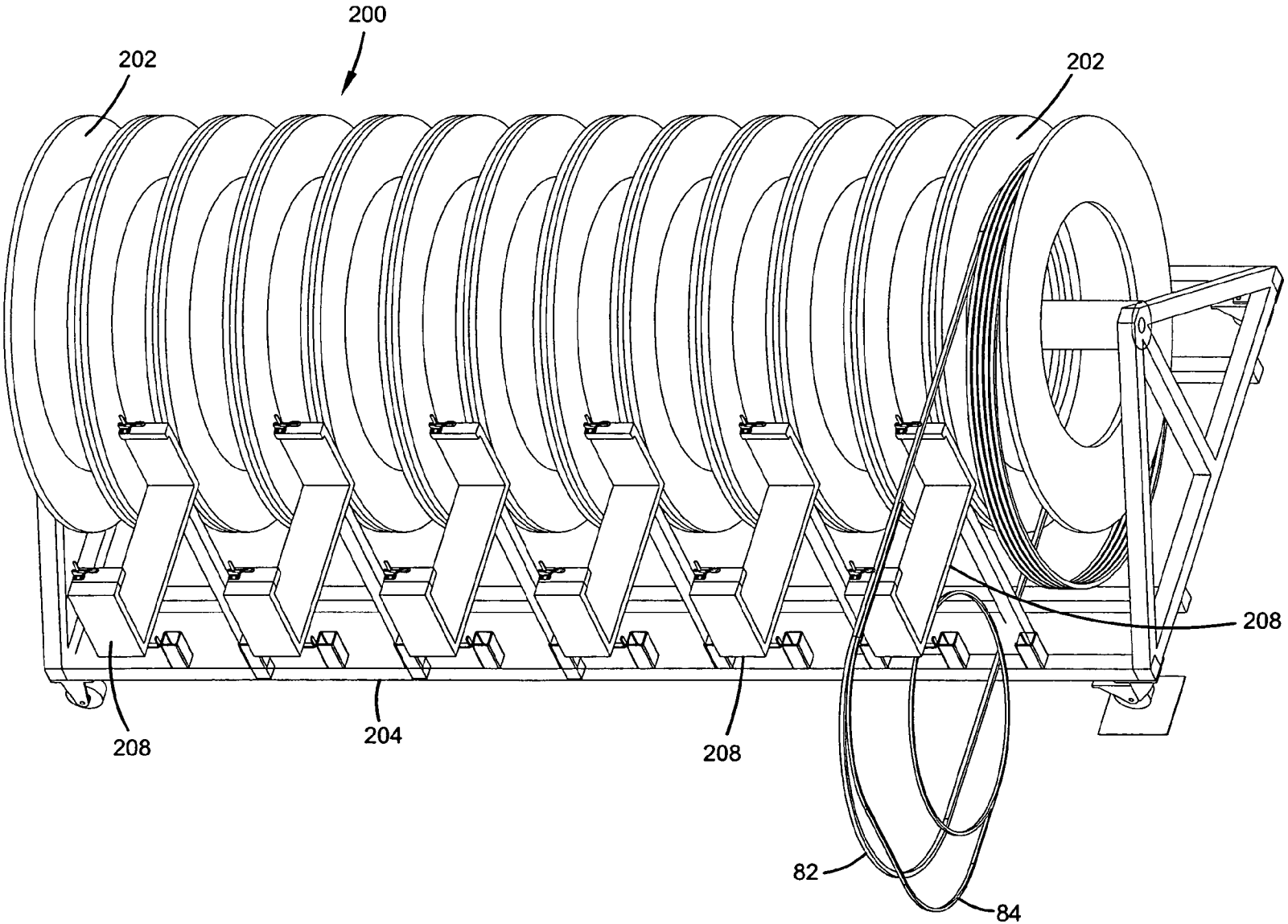
FIG. 9 is a perspective view of an alternative embodiment for a fiber handling cart including a cable partially shown and a tether.
Figure 10:
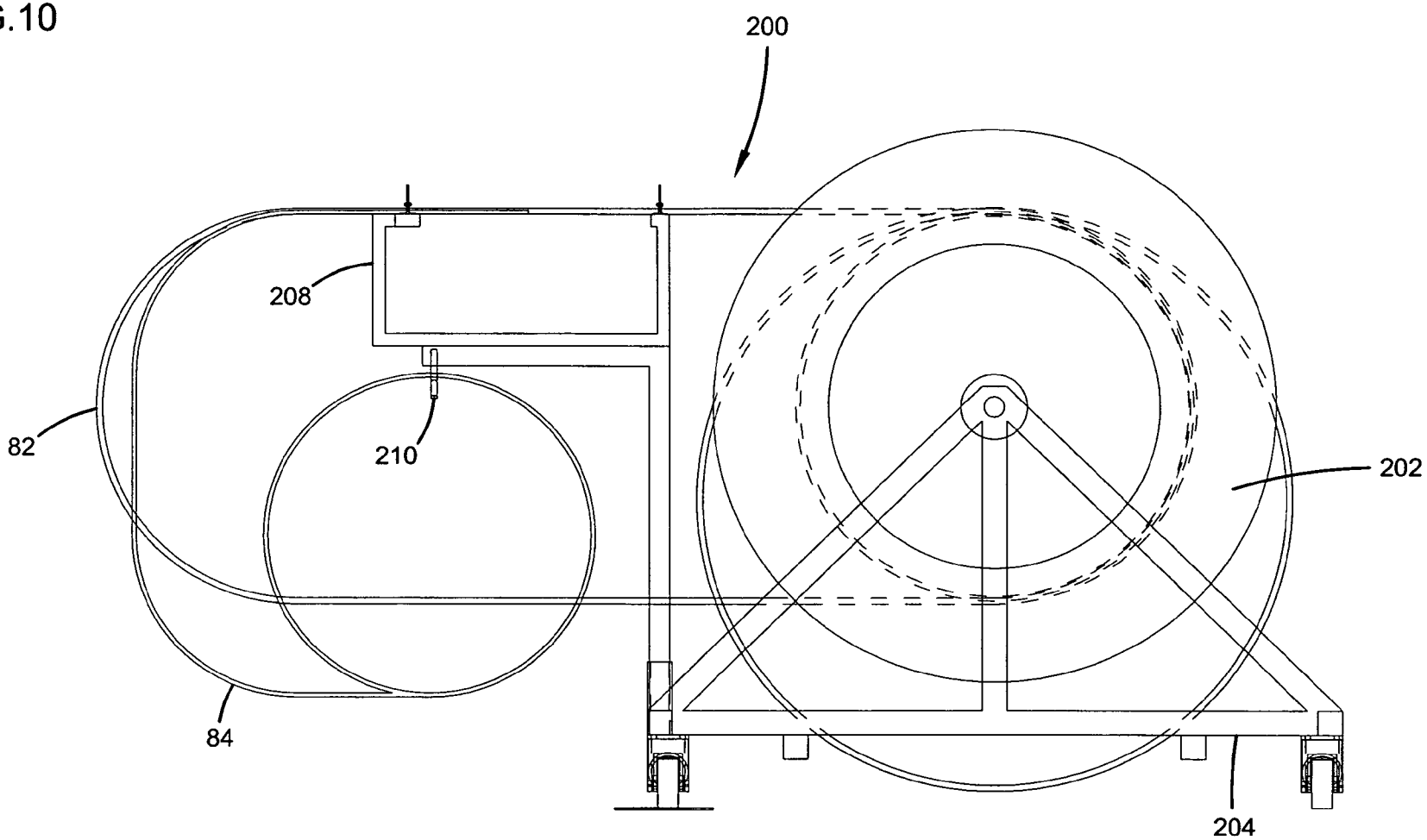
FIG. 10 is a side view of the fiber handling cart of FIG. 9.

FIGS. 9 and 10 show an alternative cart 200 with thirteen spools 202 mounted to a frame 204. Cart 200 is useful for processing a cable 82 with twelve spaced tethers 84. Cart 200 also includes fixtures 208 attached adjacent to each cable access point. The fixtures 208 can clamp to cable 82 and permit work to be done on cable 82. A cable support 210 can be used to hold the tethers 84.

The above specification, examples and data provide a complete description of the manufacture and use of the composition of the invention. Since many embodiments of the invention can be made without departing from the spirit and scope of the invention, the invention resides in the claims hereinafter appended.

We claim:

1. A fiber handling cart for handling a cable comprising:

a frame;

a plurality of spools connected together and aligned along an axis and mounted to the frame, wherein the spools are rotatable together in a first group about the axis relative to the frame;

wherein the spools are disconnectable so as to be selectively not rotatable relative to the frame, wherein the spools which are disconnected form a second group which is locked to the frame;

a crossover guide between each adjacent spool of the plurality of spools, wherein each crossover guide allows the cable to jump over to the adjacent spool as the cable is wound onto each adjacent spool in a direction from one end spool to an opposite end spool.

2. The cart of claim 1, further comprising wheels on the bottom of the frame.

3. The cart of claim 1, further comprising a clamp to hold selected spools together.

4. A fiber handling cart for handling a cable comprising:

a frame;

a spool device mounted to the frame for spooling a cable up into discrete coiled areas;

each discrete coiled area capable of unspooling a portion of the spooled up cable without unspooling an adjacent discrete coiled area;

a crossover guide between adjacent discrete coiled areas, wherein each crossover guide allows the cable to jump from each discrete coiled area to each adjacent coiled area as the cable is wound onto each discrete coiled area.

5. A fiber handling cart for handling a cable comprising:

a frame;

a plurality of spools mounted on a common shaft, the shaft rotatable relative to the frame;

a first spool of the plurality of spools locked to the shaft;

each spool of a reminder of the spools of the plurality of spools selectively lockable to either the first spool or the frame with a clamping system, wherein a cable path is defined between adjacent spools so that the cable can be wound into discrete coiled areas on the plurality of spools, wherein each spool of the remainder of the spools of the plurality of spools is either rotatable with the first spool or is locked from rotation to the frame;

wherein the clamping system has a first state where all of the spools of the remainder of the spools are locked with the first spool for rotation with the first spool;

wherein the clamping system has a second state where at least one of the spools of the remainder of the spools is locked from rotation to the frame.

6. The cart of claim 5, wherein the clamping system includes a plurality of discrete clamps which capture opposite sides of adjacent spools to restrict relative movement.

7. The cart of claim 5, further comprising wheels on the bottom of the frame.

8. A fiber handling cart for handling a cable comprising:

a frame;

a shaft rotatably mounted to the frame;

a plurality of spools mounted on the shaft in alignment along an axis of the shaft from a first spool to a last spool;

the first spool of the plurality of spools locked to the shaft;

each of a reminder of the spools of the plurality of spools selectively lockable to either the first spool or the frame with a clamping system, wherein a cable path is defined between adjacent spools so that the cable can be wound into discrete coiled areas defined by the plurality of spools;

wherein the clamping system includes a plurality of removable clamps which capture opposite sides of adjacent spools to restrict relative movement;

a flange mounted to the frame adjacent to the last spool;

wherein each spool of the remainder of the spools is clamped together either with the first spool or the flange;

a channeled crossover guide between each spool extending over the respective sides of each spool; and wheels on the bottom of the frame.

* * * * *

UNITED STATES PATENT AND TRADEMARK OFFICE

CERTIFICATE OF CORRECTION

PATENT NO. : 7,658,345 B2
APPLICATION NO. : 11/804714
DATED : February 9, 2010
INVENTOR(S) : Wells et al.

It is certified that error appears in the above-identified patent and that said Letters Patent is hereby corrected as shown below:

Col. 4, line 51, claim 5: "spool of a reminder of the spools" should read --spool of a remainder of the spools--

Col. 5, line 9, claim 8: "each of a reminder of the spools" should read --each of a remainder of the spools--

Signed and Sealed this

Sixteenth Day of November, 2010

David J. Kappos

David J. Kappos
*Director of the United States Patent and Trademark Office*